US008154396B2

(12) United States Patent
Moormeier et al.

(10) Patent No.: US 8,154,396 B2
(45) **Date of Patent: *Apr. 10, 2012**

(54) VEHICLE DISABLEMENT DEVICE

(75) Inventors: Michael P. Moormeier, Longview, WA (US); Todd O'Halloran, Damascus, OR (US)

(73) Assignee: Pursuit Management, Inc., Damascus, OR (US)

( * ) Notice: Subject to any disclaimer, the term of this patent is extended or adjusted under 35 U.S.C. 154(b) by 146 days.

This patent is subject to a terminal disclaimer.

(21) Appl. No.: 12/496,543

(22) Filed: Jul. 1, 2009

(65) Prior Publication Data

US 2009/0263191 A1 Oct. 22, 2009

Related U.S. Application Data

(63) Continuation-in-part of application No. 11/606,618, filed on Nov. 29, 2006, now Pat. No. 7,573,379.

(60) Provisional application No. 60/113,264, filed on Dec. 1, 2005.

(51) Int. Cl.
*G08B 23/00* (2006.01)

(52) U.S. Cl. ..... 340/500; 404/6

(58) Field of Classification Search ..... 340/500; 404/6, 9; 180/287
See application file for complete search history.

(56) References Cited

U.S. PATENT DOCUMENTS

| | | | | |
|---|---|---|---|---|
| 5,406,251 | A | 4/1995 | Leis | |
| 5,611,408 | A | 3/1997 | Abukhader | |
| 5,890,832 | A | 4/1999 | Soleau | |
| 6,048,128 | A | 4/2000 | Jones, III et al. | |
| 6,206,608 | B1 * | 3/2001 | Blevins | 404/6 |
| 6,409,418 | B1 * | 6/2002 | Blair et al. | 404/6 |
| 6,758,628 | B1 | 7/2004 | Curry, Jr. | |
| 6,869,248 | B1 | 3/2005 | Threlkeld | |
| 7,025,526 | B2 | 4/2006 | Blair | |
| 7,108,446 | B2 | 9/2006 | Clark | |
| 7,201,531 | B2 * | 4/2007 | Shackelford et al. | 404/6 |
| 7,275,889 | B1 | 10/2007 | McGill | |
| 7,573,379 | B2 * | 8/2009 | Moormeier et al. | 340/500 |
| 7,785,032 | B2 * | 8/2010 | Segal | 404/6 |
| 2008/0159809 | A1 | 7/2008 | Costa | |

FOREIGN PATENT DOCUMENTS

| | | |
|---|---|---|
| JP | 11140835 A | 5/1999 |
| KR | 10-0456416 | 11/2004 |

* cited by examiner

*Primary Examiner* — John A Tweel, Jr.
(74) *Attorney, Agent, or Firm* — Schwabe, Williamson & Wyatt, P.C.

(57) ABSTRACT

Embodiments of the present invention provide a vehicle disablement device that includes deployment of a tire puncture strip in front of the tire of a moving vehicle.

30 Claims, 14 Drawing Sheets

VEHICLE DISABLEMENT DEVICE

CROSS REFERENCE TO RELATED APPLICATIONS

The present application is a continuation in part of and claims priority to U.S. patent application Ser. No. 11/606,618, filed Nov. 29, 2006, now U.S. Pat. No. 7,573,379, entitled "Mobile Retractile, Lateral Deploying, Vehicle Disablement Device," the entire disclosure of which is hereby incorporated by reference in its entirety, which claims priority to U.S. provisional patent application Ser. No. 60/113,264, filed Dec. 1, 2005, entitled "Mobile, Lateral Deploying, Tire Deflation Device."

TECHNICAL FIELD

Embodiments of the present invention relate to the field of vehicle disablement systems, and, more particularly, to devices and methods of retractable and generally laterally deployable tire puncture systems and tire puncture components.

BACKGROUND

In the year 2005, there were over 750 police pursuits in the city of Los Angeles alone. In the state of California, in that same year, there were over 7,000 police pursuits. No less than three deaths, in the city of Los Angeles alone, can be attributed to those who would run from the police, recklessly endangering the lives and property of American citizens. Unfortunately, law enforcement officials have very limited resources in dealing with this problem. Solutions given to agencies thus far are only effective given a very specific set of circumstances. In addition, presently, agencies across the United States have begun to tie the hands of Law Enforcement personnel by instituting "no pursuit" policies. Although "no pursuit" policies may be the safest alternative, this is only true due to the fact that a means by which to deal with the problem does not exist.

Every single United States citizen pays for the rise in police pursuit. Studies show that damage from crashes associated with police pursuit is rarely limited to less than five figures. When you consider the fact that the acting vehicle, the police vehicles, and often times bystander vehicles, are damaged, it is not hard to understand why damage can run in excess of $100,000 per incident. This cost is passed on to citizens through higher insurance rates.

Tragedy often times follows high-speed pursuit. The fact is, that innocent people die every year. Mothers and fathers, children and elderly, all walks of life, all across America, people are dying because a tool does not exist that allows police to stop a high-speed pursuit, before it begins. No solution presently exists that allows the police, from within the safety of their vehicle, to disable a fleeing vehicle, and stop a pursuit.

Devices presently in use include U.S. Pat. No. 5,820,293 in which a device is thrown, by hand, across the roadway into the path of an oncoming pursued vehicle in order to deflate the tires. U.S. Pat. No. 5,775,832 describes a device that is used in the same manner as the previously listed device but differs in that the device itself is wider upon deployment and has a different type of spike. Although presently not in use, U.S. Pat. No. 6,623,205 describes a mobile device which when deployed is said to disable vehicle tires. Similarly, U.S. Pat. No. 5,839,849 describes a device meant to be used from within a police vehicle at speed. Devices described on television programs and magazines have included electronic remote controlled vehicles, which are said to have the ability to shut down a vehicle's computer, thus disabling said vehicle when remote controlled vehicle is driven under vehicle pursued. Scientific magazines have suggested that electromagnetic pulse may be used in the future.

Groen, U.S. Pat. No. 5,820,293 describes a device in which the police must know where the fleeing suspect is going and get there ahead of them, get out of the car and deploy said device across the roadway by hand. Similarly, Kilgrew U.S. Pat. No. 5,775,832 describes a device which must be deployed by hand across the roadway. These devices unfortunately, put the police officer in harm's way as they make it necessary for the police to exit their vehicle and stand next to the road to deploy their device. Devices such as U.S. Pat. No. 6,623,205 fail to deal with the fact that pursuits take place on every type of roadway, and that any uneven surface would damage the device described to the point it would be rendered useless and therefore necessitate costly repairs. Lowrie, U.S. Pat. No. 6,527,475 describes a device that necessitates police pulling in front of the pursued vehicle to deploy the device. Police are unwilling to do this, given the possibility that the suspect may have a weapon. Being in front of a suspect with a weapon is too dangerous for the police to even consider this course of action. The tethering of the described device provides for rapid deceleration of said device and therefore must be timed perfectly in order to be effective. In addition, the best possible use of the aforementioned device is its use when the police car is not moving.

It is therefore an object of the invention to provide a completely mobile means for vehicle disablement.

It is another object of the invention to provide for safe deployment of a vehicle disablement device by allowing deployment from within the police or operator vehicle.

It is another object of the invention to provide a vehicle disablement device that automatically retracts.

It is another object of the invention to provide a means for multiple deployments.

It is another object of the invention to provide a device that does not decelerate upon deployment.

It is another object of the invention to provide an engineered weak point and flexible joint by which the spike strip is attached to the device so as to prevent damage.

It is another object of the invention to provide a means for quick spike strip replacement without the aid of tools.

It is another object of the invention to provide a device that can be used in the blind spot of the pursued vehicle increasing officer safety.

It is another object of the invention to provide a device which can be deployed during a traffic stop to prevent suspect vehicle from leaving the scene.

It is another object of the invention to provide a maintained switch enabling deployment of device without operator maintaining pressure on deployment switch.

It is another object of the invention to provide an on-board tool for vehicle disablement.

It is another object of the invention to provide for left and right side deployment.

SUMMARY

In various embodiments, a tire puncture deployment device and tire puncture element design is provided, which, upon activation, may position a tire puncture strip carrying tire puncture elements in front of the tire of a moving vehicle and ultimately help disable the moving vehicle from within the safety of the operator's vehicle. In various embodiments, the device may be coupled to the vehicle such that the tire puncture strip may be deployed in a direction that is generally transverse to the direction of travel, which may be loosely referred to herein as "lateral deployment" or a like variation.

Devices in accordance with various embodiments may be controlled by the operator from within the vehicle by way of a control mounted within reach of either the driver or passenger of said vehicle. When deemed necessary, the system is armed using a protected switch mounted on said panel. In various embodiments, the deployment can be caused by movement of a media, such as air or other gas, liquid, etc., into the system to cause extension of a second member relative to a first member. With a tire puncture strip coupled to the second member, such that lateral extension of the second member may deploy the tire puncture strip in front of the tire of a moving vehicle. At this point, the operator of the device needs merely to apply the brakes of said vehicle, thereby causing the spike strip to travel under the pursued vehicle's tire, puncturing said tire and disabling the vehicle.

In various embodiments, the first member may be mounted at an angle with respect to a horizontal plane intersecting a first axis extending in the direction of travel. In various embodiments, the angle may be altered by rotating the first member about the first axis.

In various embodiments, the second member may be biased relative to the first member, such that extension of the second member causes loading of the bias member (e.g. springs, polymers, etc.). Once loaded, the bias member may assist in urging retraction of the second member relative to the first member. In various embodiments, evacuation of media from the first member may help retract the second member.

In various embodiments, the tire puncture strip may include a plurality of knife-like edges oriented generally parallel with the direction of travel, and also include a plurality of spikes, quills or other upstanding members that may be configured to penetrate the vehicle tire.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

For the purposes of the present invention, the phrase "A/B" means A or B. For the purposes of the present invention, the phrase "A and/or B" means "(A), (B), or (A and B)". For the purposes of the present invention, the phrase "at least one of A, B, and C" means "(A), (B), (C), (A and B), (A and C), (B and C), or (A, B and C)". For the purposes of the present invention, the phrase "(A)B" means "(B) or (AB)" that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

In various embodiments, a vehicle disablement device is shown that is adapted to deploy a tire puncture strip in a generally transverse direction relative to a fleeing vehicle's direction of travel. In various embodiments, the deployment of the strip may be caused by a number of systems, including, but not limited to electrical systems, electronic systems, fluid based systems (such as pneumatics or hydraulics), electromagnetic systems, and/or a combination thereof. In various embodiments, the vehicle disablement device may be coupled to a disablement or deployment device carrier, such as a vehicle (e.g. police), a fixed structure (e.g. post outside a parking garage), or another member/area where a moving vehicle may need to be slowed or stopped by puncturing a tire.

Figure 1:
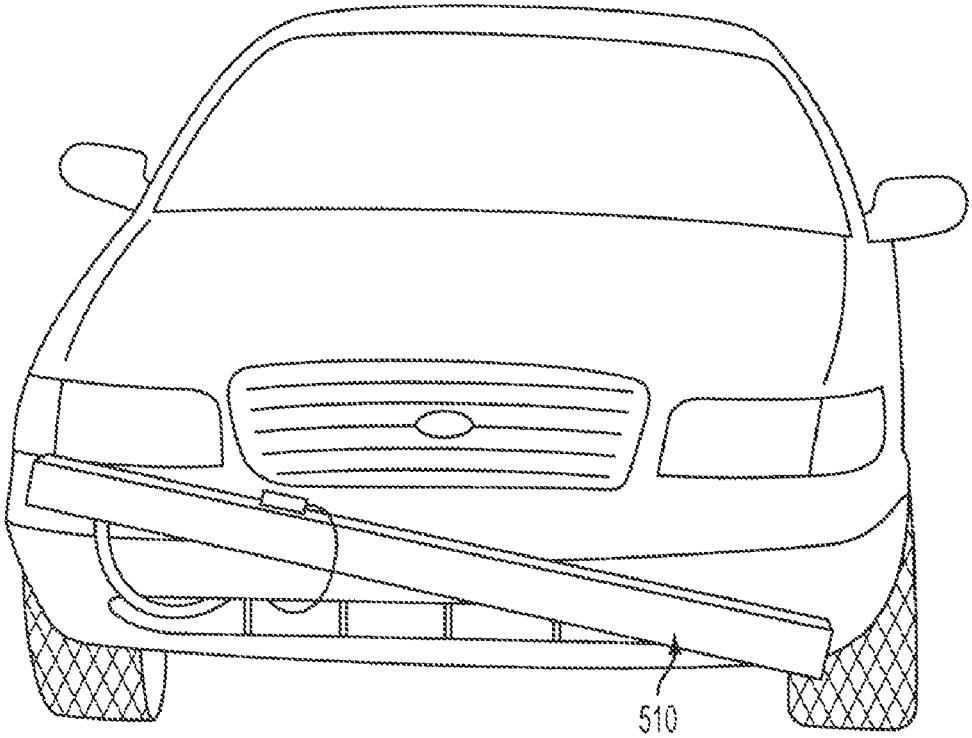
FIG. 1 is a front perspective view of a vehicle disablement device in accordance with various embodiments of the present invention.
Figure 2:
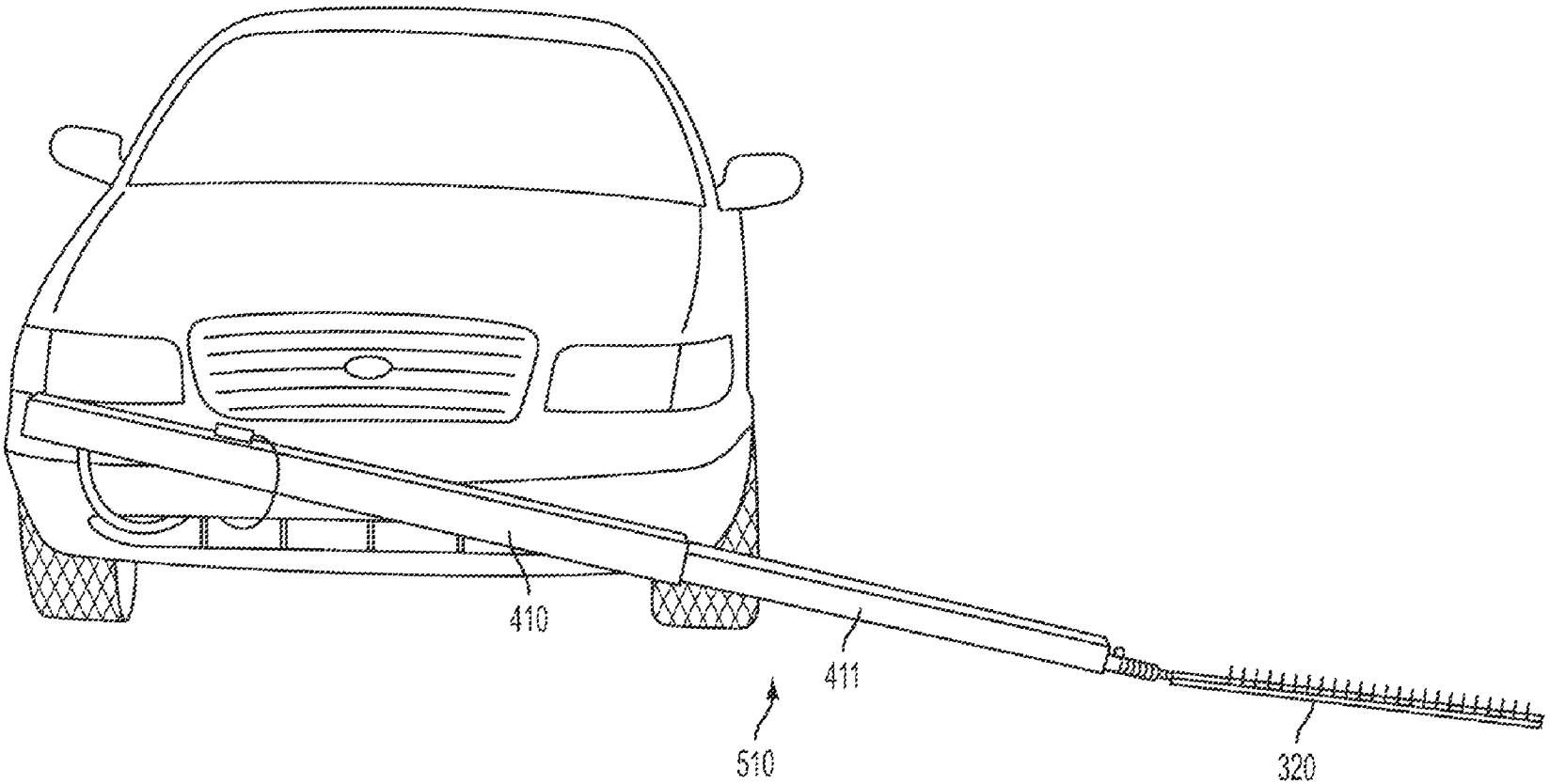
FIG. 2 is a front perspective view of a vehicle disablement device in accordance with various embodiments of the present invention.
Figure 3:
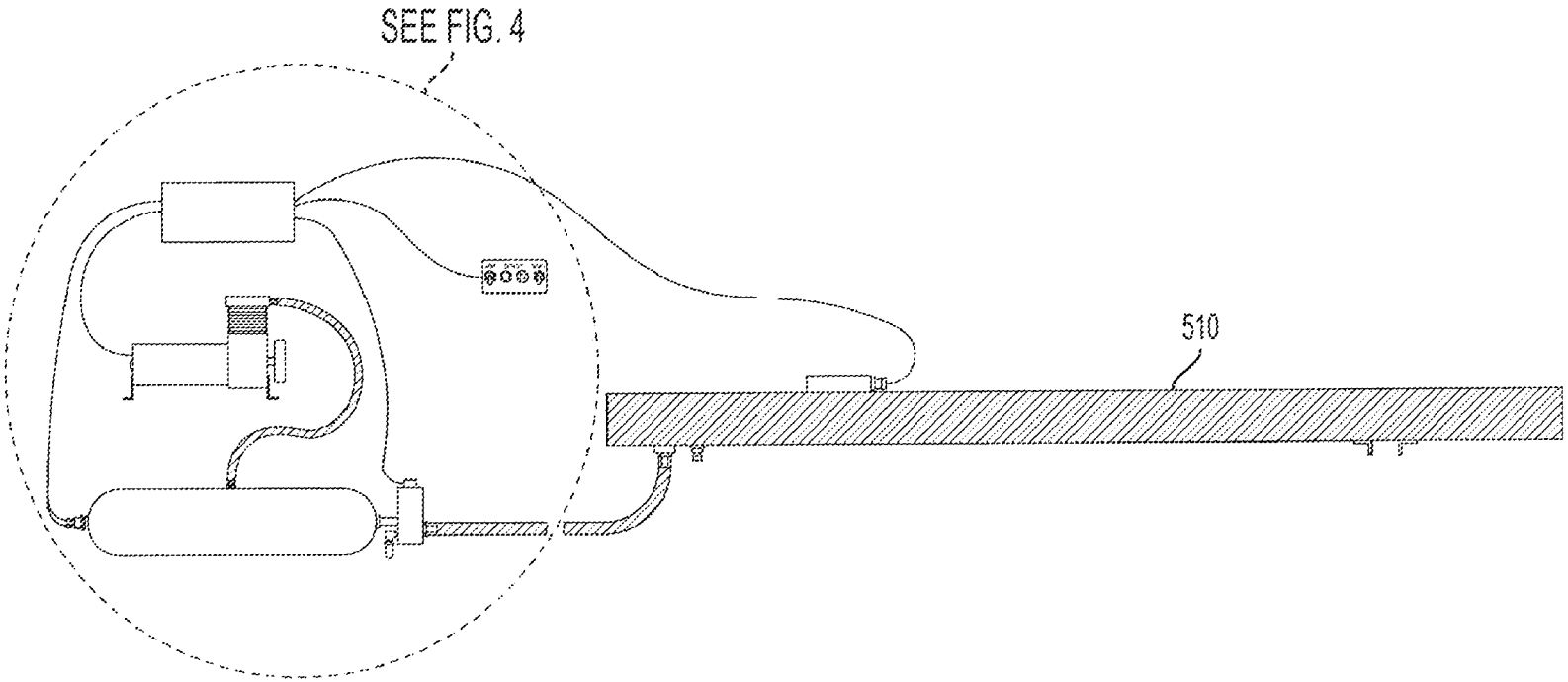
FIG. 3 is a front view of a vehicle disablement device in accordance with various embodiments of the present invention.
Figure 4:
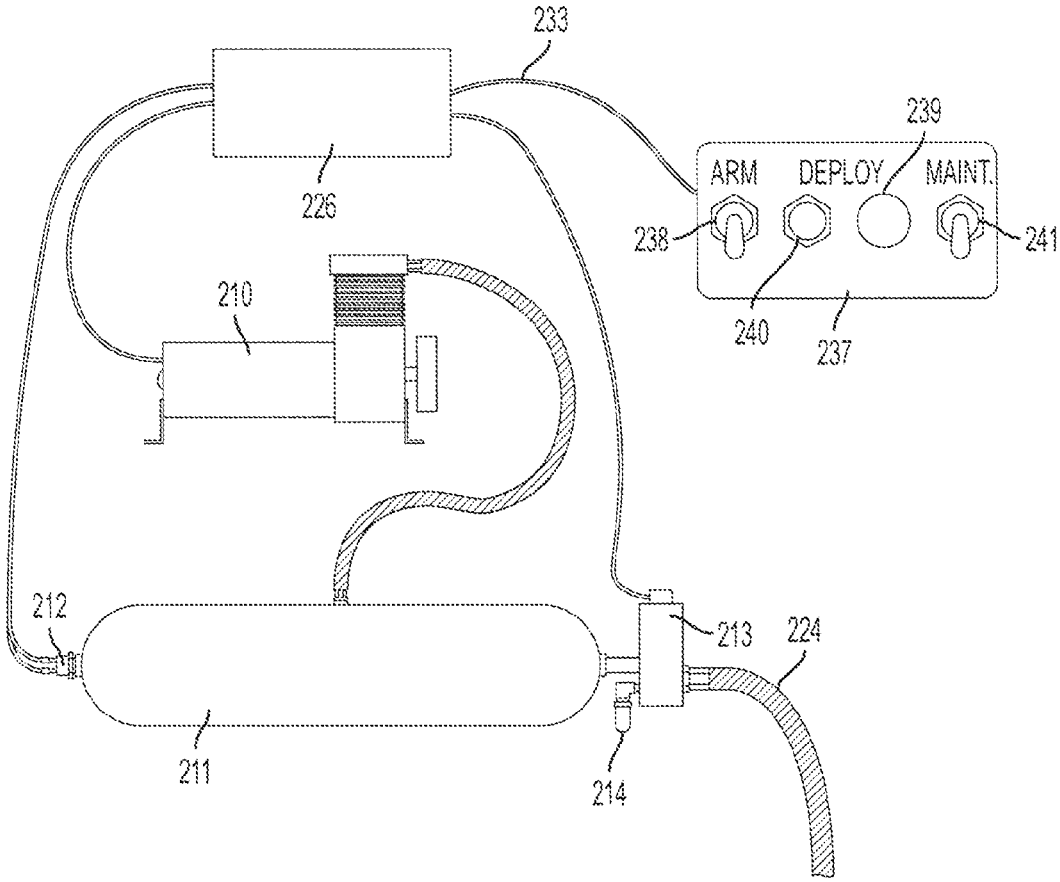
FIG. 4 is illustrates an example control system in accordance with various embodiments of the present invention.

As illustrated in FIGS. 1-3, in various embodiments, a telescoping assembly 510 may be constructed of metal, plastic, or any suitable material forming a square, rectangle or any suitable shape when viewed from either end. Telescoping assembly 510 may be coupled to an electrical and pneumatic system, which can work in conjunction to cause extension and retraction of the second member 411 relative to a first member 410. In one embodiment, these systems may include a magnetic switch, cable 232 and pneumatic air hose 224 (see e.g. FIG. 4).

In various embodiments, an air hose 224 may be a flexible, rubber-like hose (or other suitable material) that couples the first member to an air reservoir 211 via a solenoid valve 213. In various embodiments, an exhaust muffler 214 may be coupled to valve 214 to help prevent debris, insects, etc. from entering the exhaust port of solenoid valve 213. The exhaust muffler 214 may be coupled to solenoid valve 213 by conventional means and may be made of metal, plastic or other suitable material. Solenoid valve 213 may be a three way type electrically operated pneumatic control valve or suitable replacement. In various embodiments, other types of valves may be used to control the flow of media to the first member in order to help urge actuation.

Solenoid valve 213 may be electrically coupled to electrical control enclosure 226 with electrical wiring. Air reservoir 211 may be made of metal, fiberglass or other suitable material. Air reservoir 211 may be coupled to pneumatic compressor 210 using flexible, rigid or any suitable means of compressed air transfer. Pressure switch 212 may be an air pressure operated switch that has a set of electrical contacts for controlling the pneumatic compressor 210. Pressure switch 212 may be coupled to air reservoir 211 by conventional means. Pressure switch 212 may also be electrically coupled to the electrical control enclosure 226 using standard electrical wiring.

In various embodiments, a pneumatic compressor 210 may be coupled to the system and adapted to maintain a desired pressure or volume of media within the reservoir. In various embodiments, the compressor 210 may be an electric motor driven compressor or other suitable style. Pneumatic compressor 210 may be electrically coupled to electrical control enclosure 226 using standard electrical wiring. Electrical control enclosure 226 houses all wiring connections between the electrical components.

In various embodiments, electrical control enclosure 226 may be electrically coupled to dash controls enclosure 237 using panel cable 233 switch, which may be electrically coupled to panel cable 233 and mounted to dash controls enclosure 237 using conventional means. Arming switch 238 may be of the safety type with a safety snap cover to prevent unwanted operation of the switch. Arming switch 238 may be electrically coupled to dash cable and mounted to dash controls enclosure 237. Momentary deployment push button 240 is electrically coupled to dash cable and mounted to dash controls enclosure 237 using conventional means.

In various embodiments a deployed indicator light 239 may be used and be electrically coupled to dash cable and is mounted to dash controls enclosure 237 using conventional means. Maintained deployment switch 241 may be electrically coupled to dash cable and is mounted to dash controls enclosure 237 using conventional means. Dash controls enclosure 237 may provide housing for the dash area control switches used by the operator and can be made of metal, plastic or other suitable material. Dash controls enclosure 237 is mounted to the dash area or any other appropriate area within reach of operator using conventional means.

Figure 5:
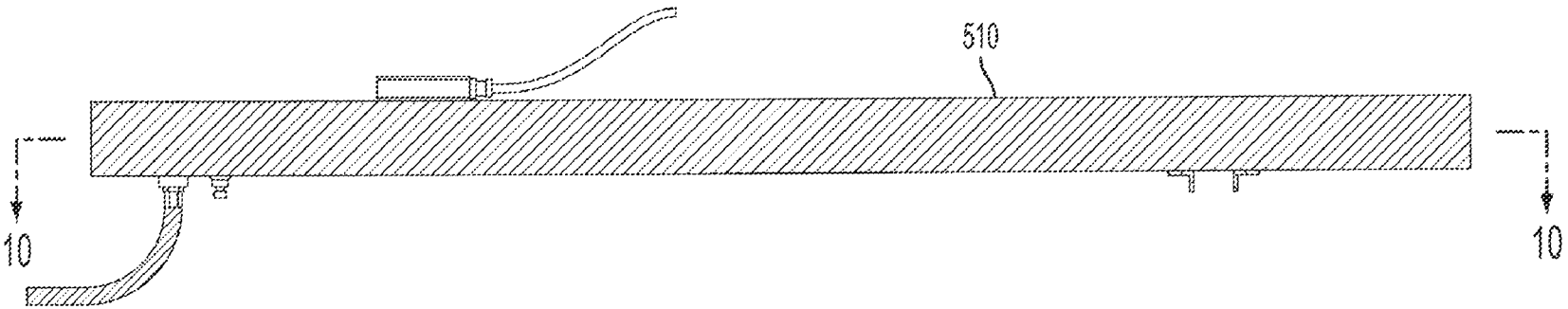
FIG. 5 is a front view of a vehicle disablement device in accordance with various embodiments of the present invention.
Figure 6:
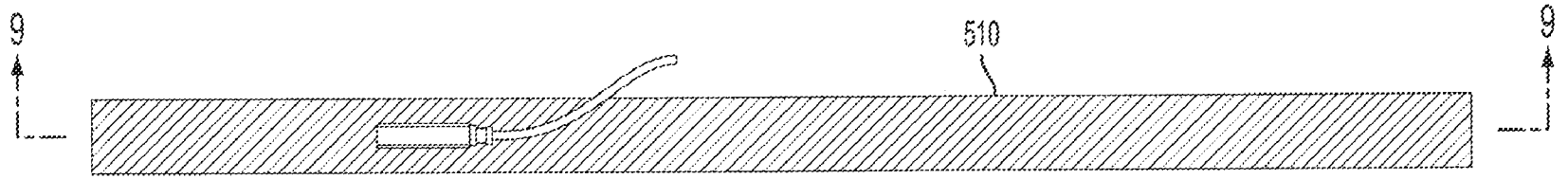
FIG. 6 is a top view of a vehicle disablement device in accordance with various embodiments of the present invention.
Figure 7:
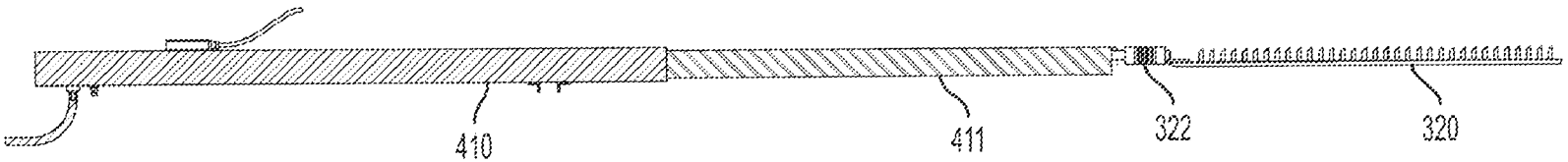
FIG. 7 is a front view of a vehicle disablement device in accordance with various embodiments of the present invention.
Figure 8:
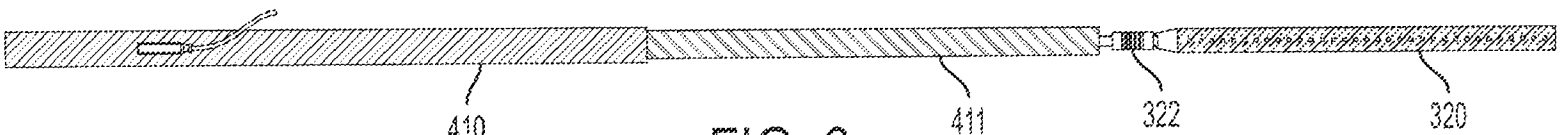
FIG. 8 is a top view of a vehicle disablement device in accordance with various embodiments of the present invention.
Figure 9:
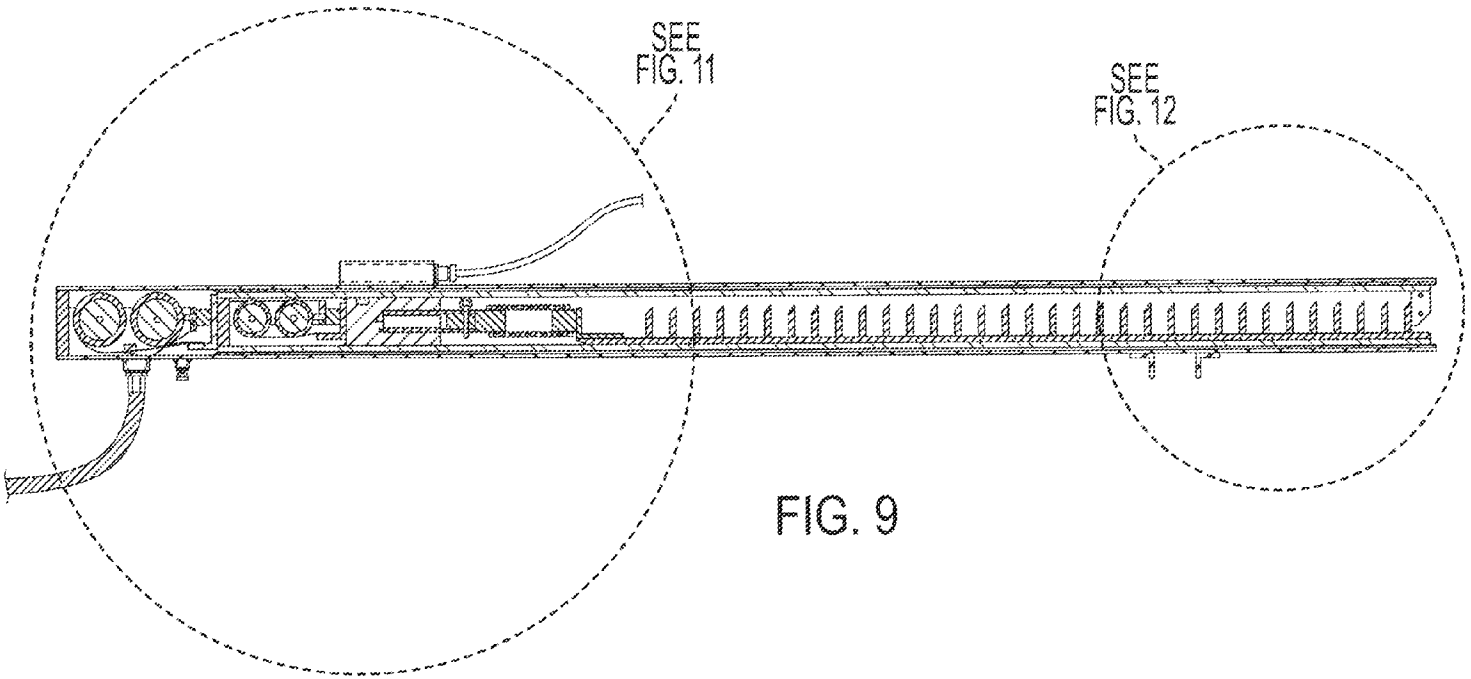
FIG. 9 is a front sectional view of a vehicle disablement device in accordance with various embodiments of the present invention.
Figure 10:
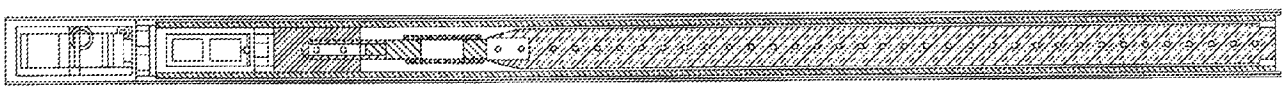
FIG. 10 is a top sectional view of a vehicle disablement device in accordance with various embodiments of the present invention.
Figure 11:
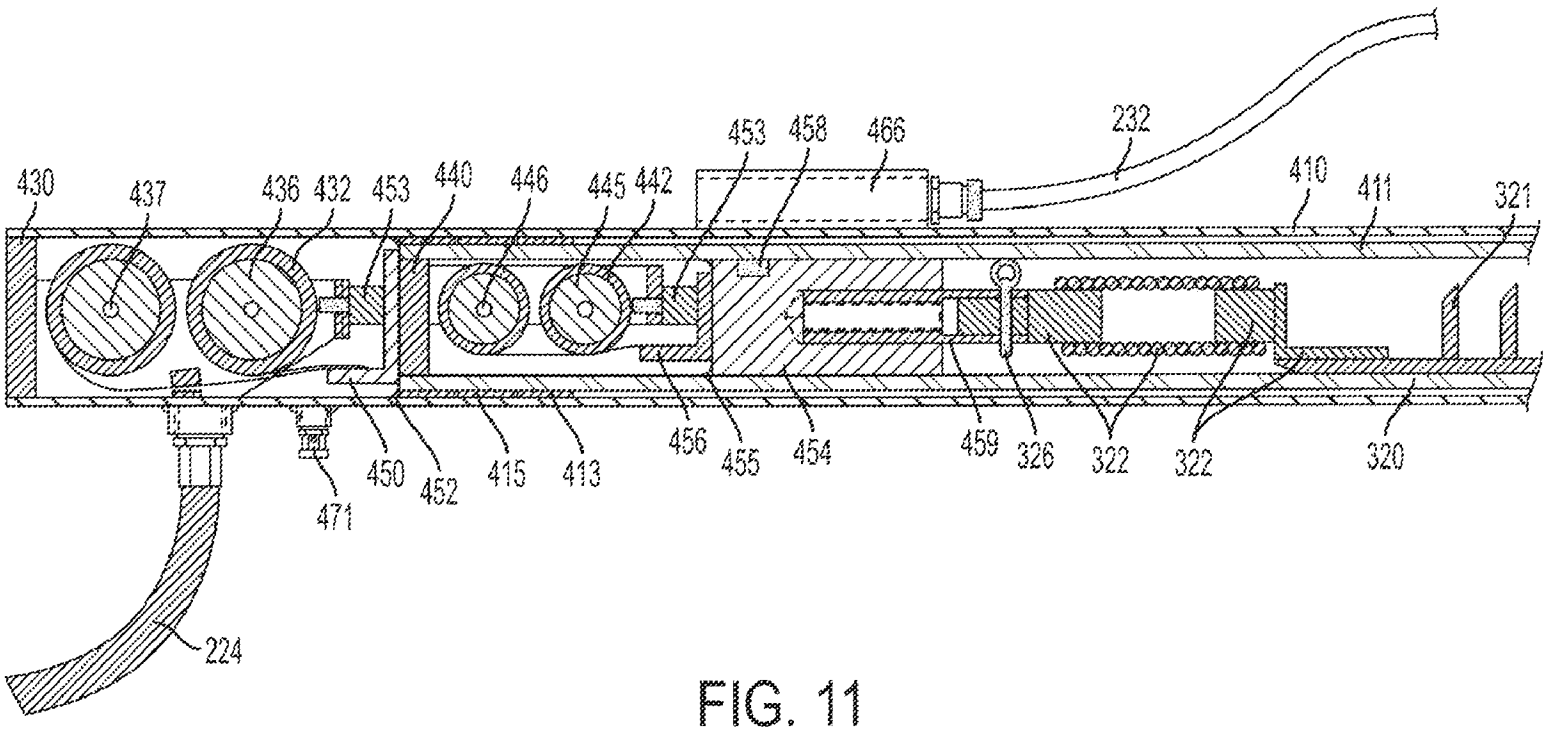
FIG. 11 is a front partial sectional detail view of a vehicle disablement in accordance with various embodiments of the present invention.
Figure 12:
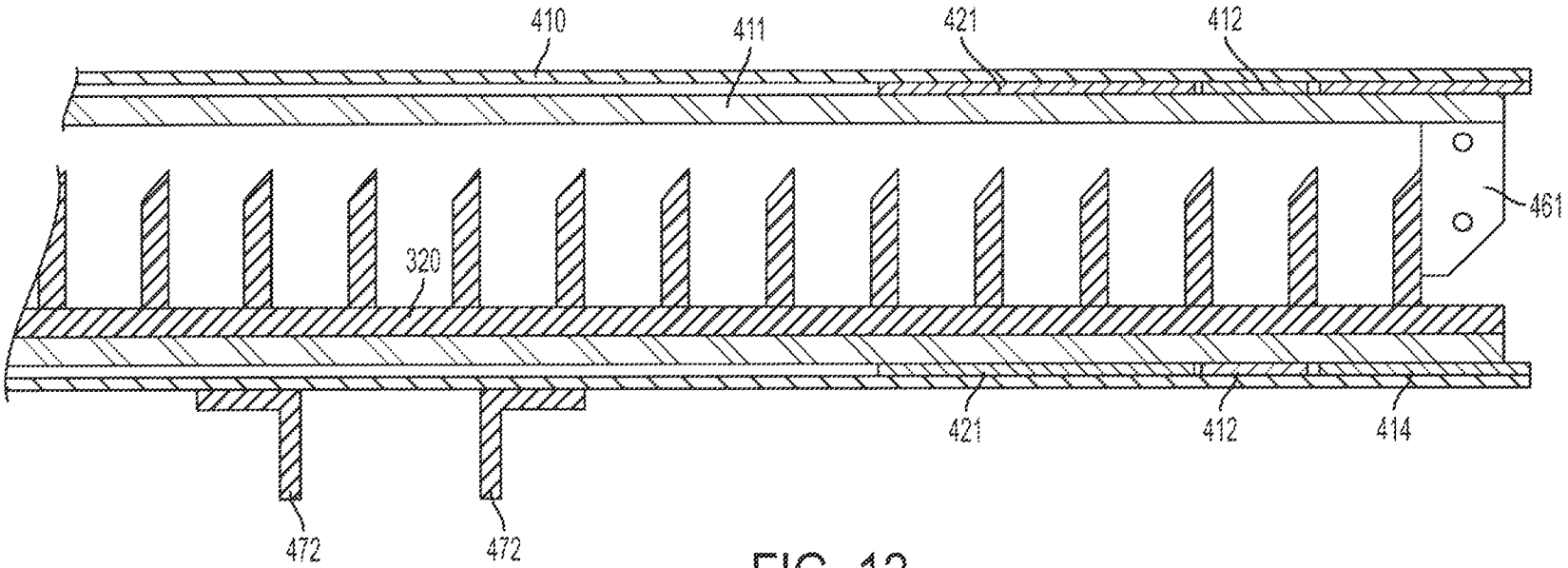
FIG. 12 is a front partial sectional view of a vehicle disablement device in accordance with various embodiments of the present invention.

FIG. 5 is a front view of a vehicle disablement device in the retracted position. FIG. 6 is a top view of a vehicle disablement device in shown in FIG. 5. FIGS. 7 and 8 are side and top views a vehicle disablement device in extended position. FIGS. 9 and 10 are side and top cross sectional views of a vehicle disablement device in retracted position. FIG. 11 is an enlarged partial side sectional view of a vehicle disablement device in retracted position. And, FIG. 12 is an enlarged partial side view of a vehicle disablement device in retracted position.

As illustrated, second member 411 (here an Inner tube) may be coupled to the first member such that it may move relative to the first member in a telescoping fashion. In various embodiments, the second member 411 may be sized to fit within first member 410. first member 410 may be fabricated from metal, plastic or other suitable material and is square, rectangle or other suitable shaped tubing. Second member 411 may be fabricated from metal, plastic, or other suitable material and is the same shape as outer tube 410. In various embodiments, the Inner tube 411 is smaller in size than outer tube 410 allowing it to be inserted inside outer tube 410. In other embodiments, the second member may be sized to slide outside the first member, on tracks, or other controlled way. A tire puncture strip (also sometime generally referred to as a spike strip) 320 may be coupled to the second member 411, such that lateral or transverse deployment of the second member relative to the first member will cause lateral or transverse extension of the tire puncture strop 320 relative to the first member 410.

In various embodiments, the tire puncture strip 320 may be pivotally coupled to the second member in such a way that allows for angular movement of the spike strip 320 relative to the first and/or second member. As the deployed spike strip engages the tire of the fleeing vehicle, for a brief moment, a significant speed differential between the disablement system and the spike strip is created, which may cause a reactionary force to be imparted on the system. Including a pivotal connection between the spike strip and the second member, much of the force may be accommodated without damage to the system, by allowing the tire puncture strip to move or swing in an angular fashion about the first and/or second members. In most instances, the deflection tends to be rearward from the home position of the strip (i.e. generally coplanar with the first and/or second members 410 and 411), as the spike strip essentially decelerates to zero miles per hour for the brief moment it first engages the tire, yet the deploying vehicle is still traveling at a determined rate.

In various embodiments, a pivot assembly 322 may couple the spike strip 320 to the second member 411. As shown in FIG. 11, in one embodiment, the pivot assembly may include a spring pivot assembly adapted to couple the spike strip 320 and the second member 411. The spring may allow for movement of the spike strip in multiple directions relative to the second member and essentially pivot about multiple axes.

This can help accommodate operational/reactionary forces encountered during the deployment activity.

In various embodiments, the pivot spring assembly may be coupled to the second member by way of a female mounting tube 459. This may provide a sturdy female opening for pivot spring assembly 322 to be inserted within and held in place by pivot spring release pin 326. Spring release pin may be a sheer type pin that can allow for separation of the spike strip from the second member 411 if the reactionary forces are too great or cause an unanticipated movement. An assembly in this regard may create a flexible and sacrificial mount for the spike strip 320. Spike strip 320 is fabricated from metal, plastic or other suitable flexible materials and may be attached to the outermost end of pivot spring assembly 322 using conventional means.

Figure 21A:
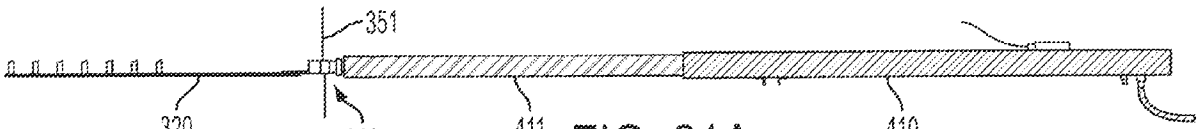
FIGS. 21A-21C illustrate various views of a vehicle disablement system in accordance with various embodiments of the present invention.
Figure 21B:
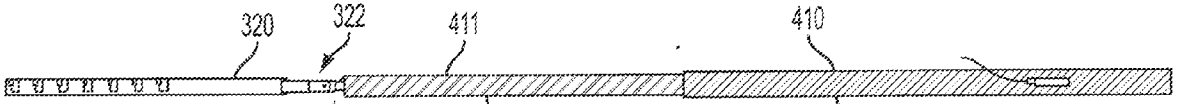
Figure 21C:
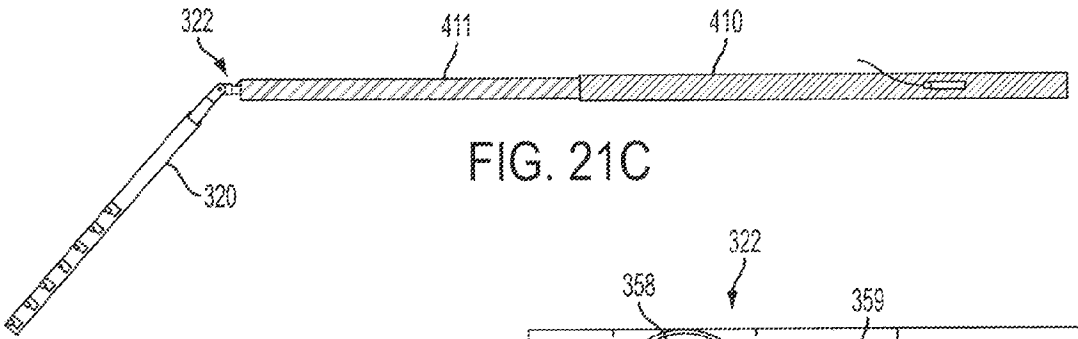
Figure 22A:
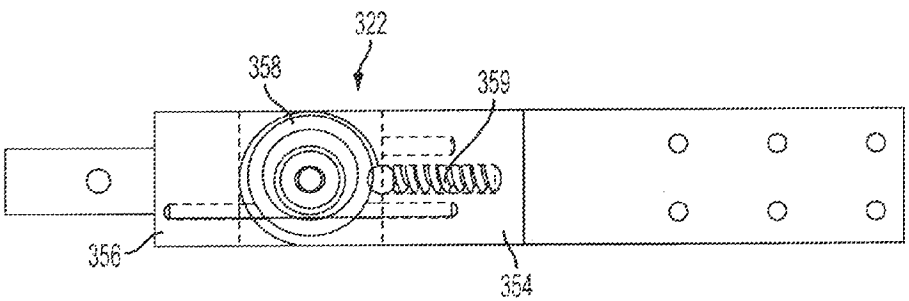
FIGS. 22A-22B illustrate a pivotal connection for a vehicle disablement system in accordance with various embodiments of the present invention.
Figure 22B:
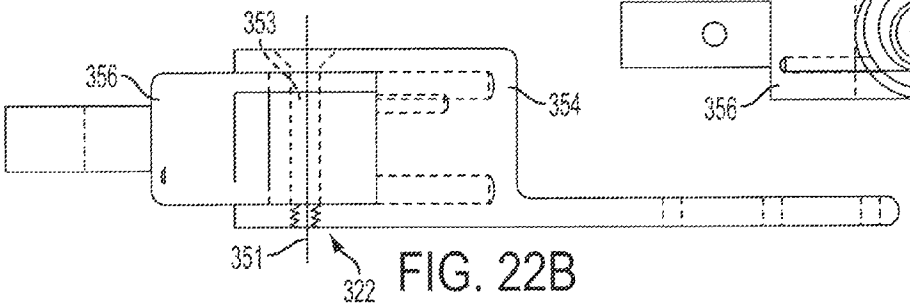

As illustrated in FIGS. 21A-21C the connection between the spike strip 320 and the second member may be a generally rigid or fixed pivotal connection about a pivot point 350, which may allow for pivoting about a pivot axis 351 in order to accommodate rearward or forward deflection from the home position of the spike strip. As illustrated in FIGS. 22A and 22B, the fixed pivot 322 may include a clevis mechanism, were a first pivot member 356 may be coupled to the second member 411 and a second pivot member 354 may be coupled to the spike strip 320. A pin 353 may couple the first pivot member to the second pivot member, thereby allowing pivotal movement about the pivot axis 351. In various embodiments, the pivotal connection may be biased, for example by a torsion spring 358, which may resist pivotal movement of the spike strip and urge the spike strip towards the home position.

Because a number of forces may be encountered during deployment (e.g. frictional forces between the spike strip and the road surface), it can be important for the spike strip to maintain its home position or coplanar relationship with the second member 411. Because the deployment forces can be greater than the resistance capacity of the biasing mechanism acting on the pivotal connection, a positive stop 359 may be used to ensure maintenance of the home position until the tire engages the spike strip, at which time the resistance force of the positive stop may be overcome and deflection allowed. In various embodiments, a spring biased detent ball type positive stop may be used. The biasing member 358 may urge the positive stop 359 to reset after the reactionary forces acting on the spike strip have subsided. In other embodiments, the retraction of the spike strip into the second member 411 may also help reset the positive stop.

In various embodiments, an air hose 224 (or other media conduit) may be coupled to threaded hole on bottom of outer tube 410 by conventional means allowing for movement of compressed air from solenoid valve 213 to telescoping assembly 510. Air hose 224 may be attached to threaded hole on bottom of outer tube 410 using a quick release coupling for convenience but is not required or limited to this means of connection. Pop off valve 471 may be a pressure relieving device that prevents excessive pressure within telescoping assembly 510 and is attached to threaded hole on bottom of outer tube 410 by conventional means. Outer tube spring housing 430 may be fabricated from metal, plastic or other suitable material.

In various embodiments, the movement of the second member 411 relative to the first member 410 may be biased, such that after deployment, the second member may be urged to retract axially towards the first member. The biasing member may be one or more springs or elastomer based biasing elements. In various embodiments, removal of the fluid, e.g. air from the first member may also help urge retraction.

In one embodiment, the first member may include an outer tube spring housing 430 which is sealed and fastened using conventional means. Spring drum axles 437 may be mounted within outer tube spring housing 430 using conventional fasteners. Spring drums 436 may be fabricated from plastic or other suitable material and provide a wheel-like action for the constant force springs 432 to coil and uncoil upon. Spring drums 436 may be mounted and rotate upon spring drum axles 437. Large constant force springs 432 may be coiled around the circumference of large spring drums 436 and attached to constant force springs end mount 450 using conventional means. Constant force springs end mount 450 may be fabricated from metal, plastic or other suitable material. In various embodiments, the system may include outer tube spring housing bumpers 453 may be made of a rubber-like material and fastened with a threaded stud or other suitable means. Outer tube spring housing bumpers 453 may be attached to outer tube spring housing 430 using conventional means. Large constant force springs end mount 450 may be fabricated using metal, plastic or other suitable materials. Large constant force springs end mount 450 may be fastened to inner tube spring housing 440 using conventional means. Inner tube seal 452 may be made of rubber-like, plastic or other suitable material and fits the shape of the inside walls of the outer tube 410. Inner tube seal 452 may be sandwiched between large constant force springs end mount 450 and inner tube spring housing 440 and may be held in place by the compression force of the fasteners which attach large constant force springs end mount 450 to inner tube spring housing 440. Inner tube plastic bearing plates 415 may be fabricated from sheet plastic or other suitable low friction material and may be slightly thinner than the clearance between outer tube 410 and inner tube 411. Inner tube plastic bearing plates 415 may be fastened to the outside surfaces at the innermost end of inner tube 411. Inner tube plastic bearing plates 415 provide a low friction surface for the innermost end of inner tube 411 to slide within outer tube 410. Inner tube stop plates 413 may be fabricated from sheet metal or other suitable high strength material. Inner tube stop plates 413 may be fastened to the outside surfaces of the inner tube 411 adjacent to inner tube plastic bearing plates 415. Inner tube spring housing 440 may be fabricated from metal, plastic or other suitable material and houses the small constant force springs 442 with their associated small spring drums 445 and small spring drum axles 446. Inner tube spring housing 440 also provides a mount for inner tube spring housing bumper 451. Inner tube spring housing 440 may be inserted into inner tube 411 and may be sealed and fastened using conventional means. Small spring drum axles 446 may be female threaded metal or other suitable material and may be mounted within inner tube spring housing 440 using conventional fasteners. Small spring drums 445 may be fabricated from plastic or other suitable material and provide a wheel-like action for the small constant force springs 442 to coil and uncoil upon. Small spring drums 445 may be mounted and rotate upon small spring drum axles 446. Small constant force springs 442 may be coiled around the circumference of small spring drums 445. Small constant force springs end mount 456 may be fabricated from metal, plastic, or other suitable and fastened to inner most end of piston 454 using conventional means. Piston seal 455 may be made of rubber-like, plastic or other suitable material and fits the shape of the inside walls of the inner tube 411 and may be sandwiched between small constant force springs end mount 456 and piston 454. Piston seal 455 may be held in place by the compression force of the fasteners which attach small constant force springs end mount 456 to piston 454. Magnet 458 may be of the high force permanent type or other suitable style and may be mounted within a recess of the piston 454 using friction, adhesives or other suitable means. This recess may be deep enough to prevent the magnet 458 from rubbing inner tube 411. Magnetic switch 466 may be of the reed type switch that may be activated by the presence of a magnetic force in the immediate area. Magnetic switch 466 senses the magnet 458 that may be mounted within piston 454. Magnetic switch 466 may be mounted to the exterior of outer tube 410 using welds, adhesives or other suitable means of attachment. Magnetic switch 466 may be electrically coupled to electrical control enclosure 226 with magnetic switch cable 232. Piston 454 may be fabricated from plastic or other suitable low friction material and provides a sturdy mount for pivot spring assembly female mounting tube 459. Piston 454 may be inserted inside of inner tube 411 and travels between inner tube spring housing bumper 451 and piston end stops 461. Pivot spring assembly female mounting tube 459 may be fabricated from metal pipe, metal bar stock or other suitable high strength material. Pivot spring assembly female mounting tube 459 may be inserted inside of a drilled or machined hole in the outermost end of piston 454 and may be fastened using conventional means.

In various embodiments, first member anti slide brackets 472 may be included and fabricated from metal, plastic or other suitable material. The Brackets may be attached to outside bottom of first member 410 using conventional means. Brackets 472 may help prevent telescoping assembly 510 from sliding in vehicle mounting brackets. Stop plate bumpers 421 may be fabricated from rubber-like sheets or other suitable material and may be housed between the outer sides of inner tube 411 and inner sides of outer tube 410. Stop plate bumpers 421 may be thinner than the space between inner tube 411 and outer tube 410 allowing stop plate bumpers 421 to float freely between inner tube stop plates 413 and outer tube stop plates 412. Stop plate bumpers 421 provide a cushion between inner tube stop plates 413 and outer tube stop plates 412 when inner tube 411 reaches outer most end of extension. In various embodiments the stop plate bumpers 421 may be coupled to the inner tube 411, outer tube 410 and/or one or both of the tube stop plates 413 and 412, such that they don't "float" relative to the component to which they are coupled.

Outer tube stop plates 412 may be fabricated from sheet metal or other suitable high strength material and may be fastened to inside surfaces of outer tube 410 adjacent to outer tube plastic bearing plates 414 using conventional means. Outer tube plastic bearing plates 414 may be fabricated from plastic sheet or other suitable low friction material and may be fastened to inside surfaces of outer most end of outer tube 410. Outer tube plastic bearing plates 414 may be slightly thinner than clearance between outer tube 410 and inner tube 411. Outer tube plastic bearing plates 414 provide a low friction surface for inner tube 411 to slide within outer tube 410. Piston end stops 461 may be fabricated from metal or other suitable high strength material and may be fastened to two opposite inside surfaces at outer most end of inner tube 411 by conventional means. Piston end stops 461 also serve the function of limiting the travel of spike strip 320 upward within inner tube 411.

Figure 15:
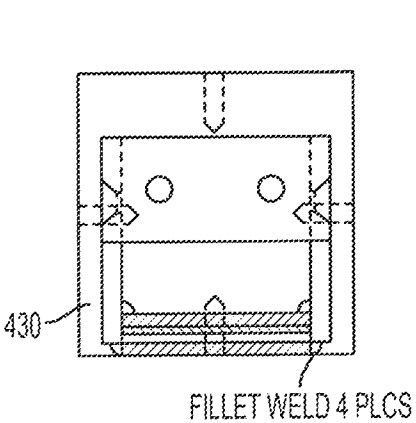
FIGS. 13-20 illustrate various views of a spring housing and related components in accordance with various embodiments of the present invention.
Figure 14:
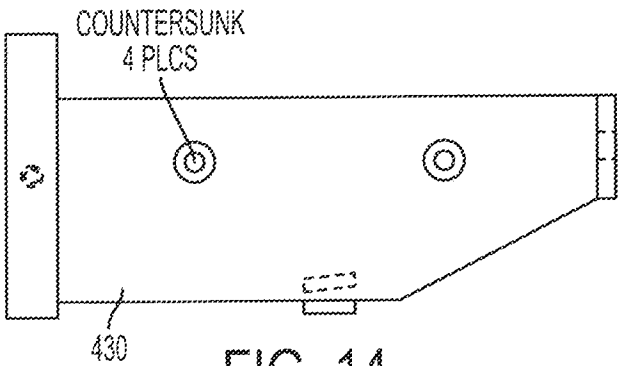
Figure 16:
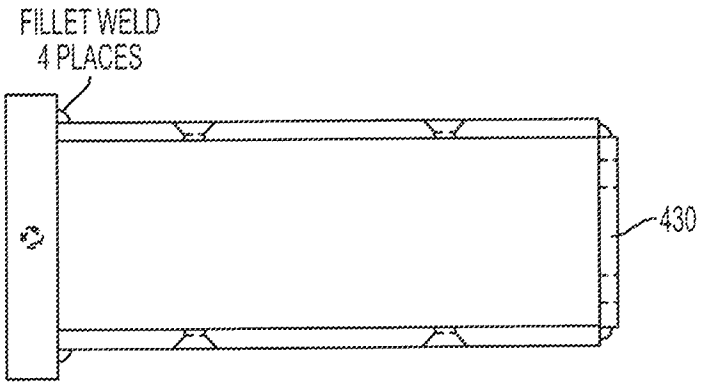
Figure 13:
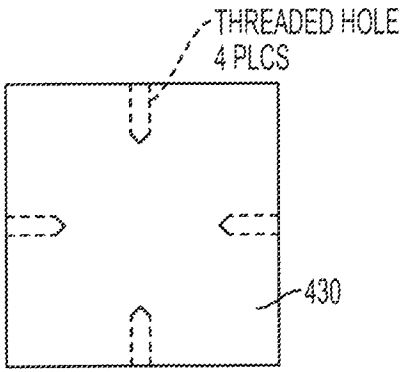
Figure 19:
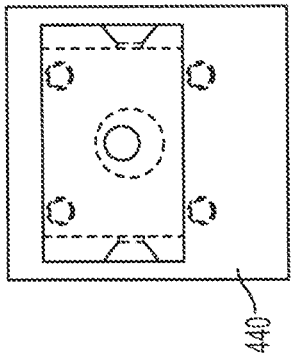
Figure 18:
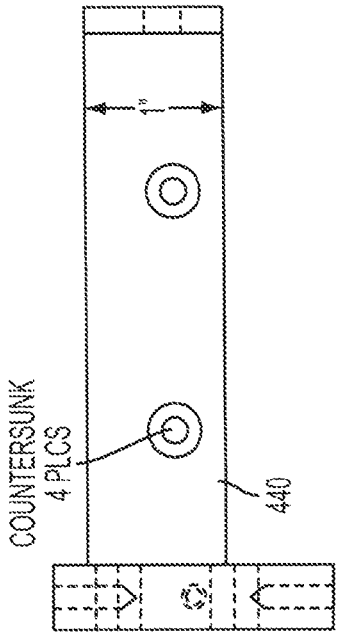
Figure 20:
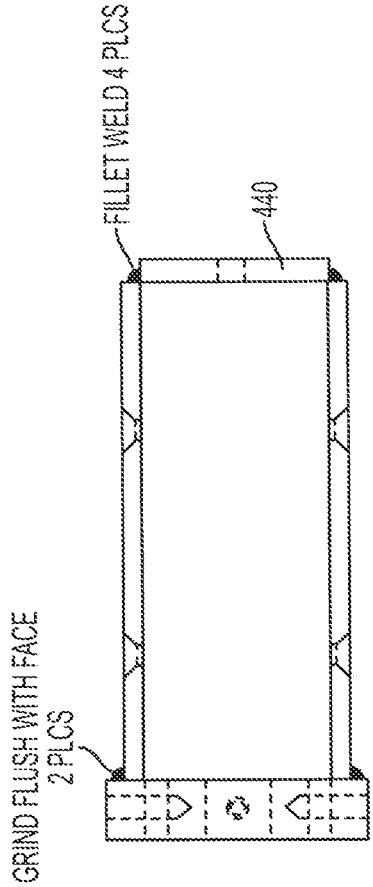
Figure 17:
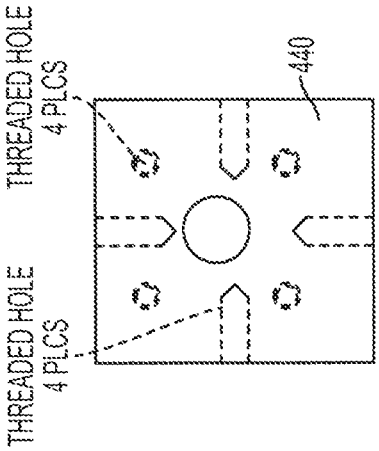

FIG. 13 is a left detail view of the outer tube spring housing 430. FIG. 14 is a front detail view of the outer tube spring housing 430. FIG. 15 is a right detail view of the outer tube spring housing 430. Outer tube spring housing 430 may be fabricated from metal, plastic or other suitable material and is shown as a welded metal assembly. However the outer tube spring housing 430 can be glued or machined if suitable. FIG. 16 is a top detail view of the outer tube spring housing 430. Outer tube spring housing 430 may be fabricated from metal, plastic or other suitable material and is shown as a welded metal assembly. However the outer tube spring housing 430 can be glued or machined if suitable. FIG. 17 is a left detail view of the inner tube spring housing 440. FIG. 18 is a front detail view of the inner tube spring housing 440. FIG. 19 is a right detail view of the inner tube spring housing 440. FIG. 20 is a top detail view of the inner tube spring housing 440. Inner tube spring housing 440 may be fabricated from metal, plastic or other suitable material and is shown as a welded metal assembly. However the inner tube spring housing 440 can be glued or machined if suitable.

In various embodiments, the tire puncture strip or member 320 may include a plurality of tire puncture elements that are configured to puncture a tire. As illustrated in FIGS. 2, 7, 11, and 12, in various embodiments, tire puncture elements may include generally upstanding pointed members 321, which may be spikes, quills, or other projections configured to penetrate a tire. In various embodiments, the pointed members 321 may be coupled to the strip 320 such that they remain secured to the strip 320 after the pointed members 321 have penetrated the tire.

In other embodiments, pointed members 321 may be removably coupled to the strip 320, such that once they engage the tire, they will separate from the strip and stay in the tire. This may have the effect of providing a passage for air in the tire to escape to the atmosphere, which may be particularly helpful when the fleeing vehicle is using, for example, run flat type of tires. In various embodiments, pointed members 321 may be inserted into holes in strip 320 and held in place by friction, adhesives, mounting members, or other suitable means.

Figure 23A:
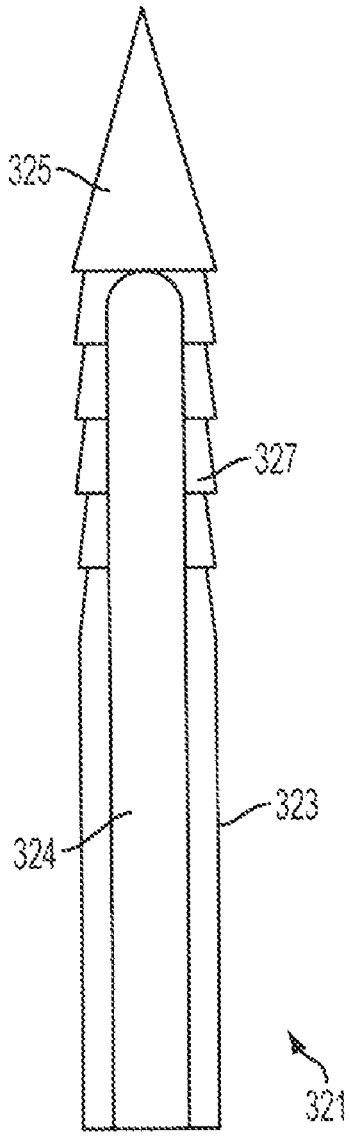
FIGS. 23A and 23B illustrate a puncture element in accordance with various embodiments of the present invention.
Figure 23B:
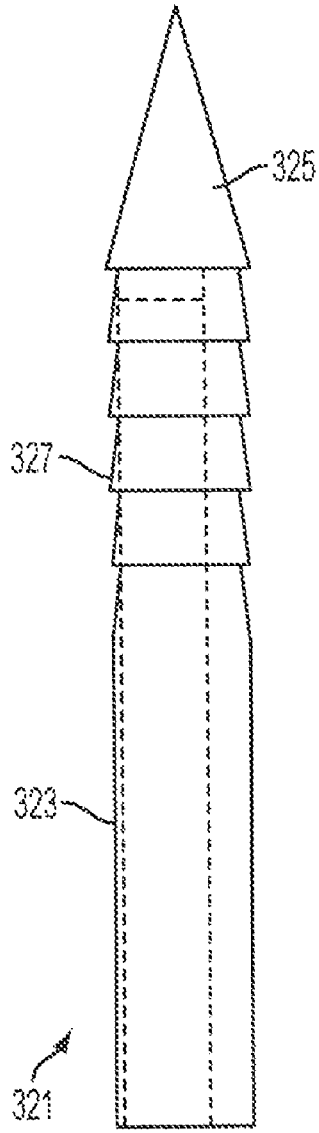

As illustrated in FIGS. 23A and 23B, pointed member 321 may include a generally pointed head portion 325 and a body portion 323. Body portion 323 may include a slot 324 running along a large portion thereof, which may help provide a means for air to escape the tire. Other body penetration configurations may be used, such as a generally hollow body with perforations of a variety of geometrical shapes which may be can allow air to pass from the inner portion of the tire to the outside.

The body 323 may include a portion which is barbed or includes surface features 327 that are configured to allow further penetration of the pointed member 321 into the tire and resist disengagement of the pointed member 321 from the tire. Tire pointed members 321 may be fabricated from metal or other suitable high strength material. Pointed members 321 may include a head portion 325 that is conical, of the needle type, broad head arrow type or other type suitable for penetrating a tire.

In various embodiments, puncture elements may also include a plurality of knife edges adapted to slice a tire as a result of engagement. In various embodiments, a knife edge may be used alone or in conjunction with a plurality of upstanding members to help deflate a tire. FIGS. 24A-24D illustrate an embodiment where the upstanding member is used in conjunction with a plurality of knife edges.

A plurality of knife edges 330 may be disposed along a portion of the length of the strip 320 and oriented such that a sharpened edge extends generally from a forward or leading portion 332 of the strip 320 to a trailing or rear portion 331 of the strip 320. In various embodiments the knife edge 330 may have an apex 333, separating a forward knife edge portion 335 and a rearward knife edge portion 334. In one embodiment, the angle between the forward portion and the apex is different from the angle formed between the apex and the rearward knife edge portion. In one embodiment the forward knife edge portion is shorter in length than the rearward knife edge portion. As the tire engages the leading portion 332, the knife edge my cause a slice to be made in the tire as it passes from one end to the other.

A plurality of pointed members 321 may be disposed along a portion of the length of the strip 320, and configured to puncture the tire, as described above.

Figure 24A:
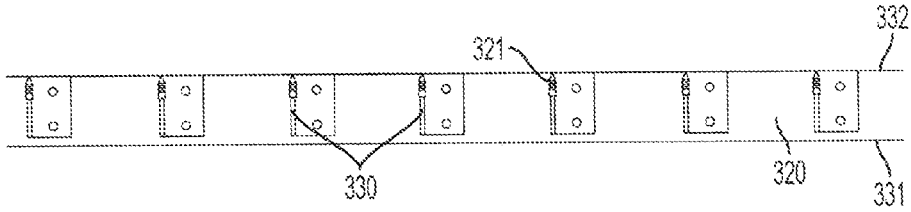
FIGS. 24A-24D illustrate a tire puncture strip in accordance with various embodiments of the present invention.
Figure 24B:
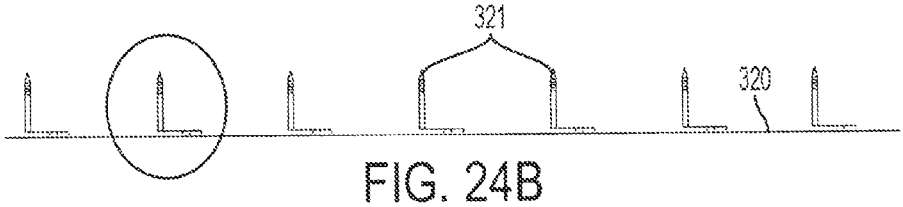
Figure 24C:
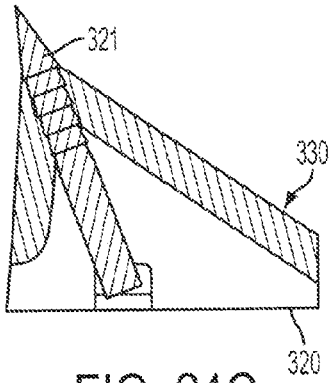
Figure 24D:
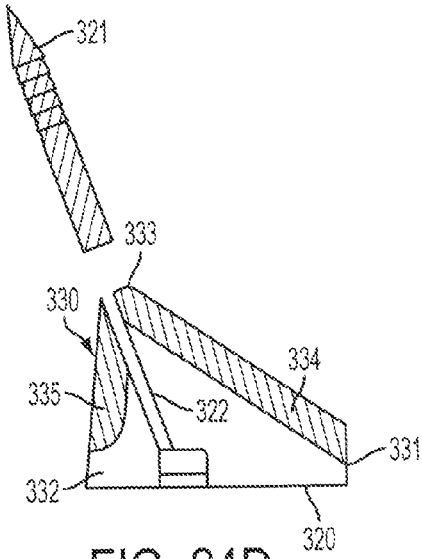

In various embodiments, the plurality of pointed members 321 may be disposed in line with a corresponding knife edge, as illustrated in FIGS. 24A-24C. So positioned, the knife edge and the pointed member may work in conjunction to help improve the effectiveness of the tire puncture strip 320. In one embodiment, the pointed member 321 may include slot 324 (FIG. 23), and knife edge 330 may include a slot, which allows for the pointed member to removably engage the knife edge. So configured, the knife edge may help removably support the pointed member before, during and after deployment of the strip 320. Further, having the knife edge create a slit in the tire around the area of the pointed member insertion, may facilitate escape of the air from the tire, as well as accelerate tire destruction.

In various embodiments, the pointed member may be disposed towards the rearward portion 331 of the strip 320, and yet be positioned such that the pointed member engages the tire prior to the knife edge engaging the tire. In various other embodiments, the knife edge may engage the tire prior to or simultaneously with the pointed member, which may help facilitate insertion of the pointed member into the tire.

In various embodiments, the pointed member may also be disposed at an angle with respect to vertical. Angular positioning may help ensure success of insertion of the pointed member 321 into the tire for several reasons. First, the tire is round, angular position may help ensure that the pointed member engages the tire in more direct manner. Second, engagement of the strip by the tire may cause some rotational movement of the strip, and the angle may help cause the pointed member to roll into a more engagable position and resist rolling too far such that deflection occurs. Third, the angled position may allow for more rigid support by the knife edge. In various embodiments, the angle relative to the vertical may be between 0 and 45 degrees.

While embodiments of the spike strip have been described with respect to a laterally deploying device, spike strips in accordance with the various embodiments described above may be used with other deployment mechanisms, or may be manually positioned in a road or in the path of a fleeing vehicle.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments illustrated and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A moving vehicle disablement device, including:

a tire puncture strip including a plurality of projection elements adapted to engage a vehicle tire;

a first deployment member adapted to couple to a disablement device carrier generally transverse to the moving vehicle's direction of travel;

a second deployment member sized to slidingly engage the first deployment member, the second deployment member having a first end adapted to allow axial movement of the second deployment member relative to the first member and help resist separation of the second member from the first member, the second member having a second end adapted to couple to the tire puncture strip; and a movable joint coupling the second member to the tire puncture strip, and adapted to allow movement of the tire puncture strip about one or more axes.

2. The vehicle disablement device of claim 1, wherein the flexible joint is designed to be a weak point in the device such that it will break before other components of the system, thus allowing for separation of the strip from the second deployment member.

3. The vehicle disablement device of claim 1, wherein the first deployment member is mounted to the vehicle at an angle relative to horizontal in order to direct the second deployment member towards the ground.

4. The vehicle disablement device of claim 3, wherein the angle of the first deployment member may be adjusted about a first axis that is generally horizontal and parallel with the direction of travel.

5. The vehicle disablement device of claim 3, wherein the first deployment member may be moved about a second axis that is generally transverse to the first axis.

6. The vehicle disablement device of claim 1, further comprising a media reservoir coupled to the first deployment member and adapted to deploy media to and from the first member to controllably cause axial extension and/or retraction of the second deployment member relative to the first deployment member.

7. The vehicle disablement device of claim 6, wherein the media is air, and further comprising a compressor configured to maintain a desired air pressure in the media reservoir.

8. The vehicle disablement device of claim 6, further comprising a controller adapted to be mounted in the vehicle, and further coupled to the media reservoir to control the movement of media to and from the first deployment member.

9. The vehicle disablement deployment device of claim 1, further comprising one or more biasing elements coupled to the first deployment member and the second deployment member, wherein the biasing elements may help urge axial movement of the second deployment member relative to the first deployment member.

10. The vehicle disablement device of claim 9, wherein the biasing elements include one or more springs adapted to cause retraction of the second deployment member relative to the first deployment member.

11. The vehicle disablement device of claim 1, wherein the tire puncture elements include a plurality of pointed upstanding members and a plurality of knife edges.

12. The vehicle disablement device of claim 11, wherein a separate one of the plurality of pointed members are positioned in line with a corresponding separate one of the plurality of knife edges.

13. The vehicle disablement device of claim 11, wherein the pointed member is adapted to engage the tire prior to the knife edge engaging the tire.

14. The vehicle disablement device of claim 1, wherein the movable joint is rigidly coupled to the second deployment member and the tire puncture strip in that it allows only movement about a first axis, wherein movement about the first axis permits movement of the tire puncture strip at least rearward of a tire puncture strip home position to help accommodate operational forces encountered when the tire puncture strip engages a tire.

15. The vehicle disablement device of claim 1, wherein the movable joint includes a spring member that allows for multiple degrees of movement about multiple axes to help accommodate operational forces encountered when the tire puncture strip engages a tire.

16. The vehicle disablement device of claim 1, further comprising a biasing element that permits limited additional axial movement of the spike strip relative to the first deployment member to help accommodate operational forces encountered when the tire puncture strip engages a tire.

17. The vehicle disablement device of claim 1, wherein the disablement device carrier is a vehicle.

18. A method of disabling a moving vehicle, comprising:

providing a tire puncture strip deployment device coupled to a deployment device carrier, the device including a first deployment member and a second deployment member slidingly engaged with the first member, and a joint coupling the second member to the tire puncture strip and adapted to allow for movement of the tire puncture strip about one or more axis;

ensuring the deployment device carrier is positioned such that the tire puncture strip deployment device is proximal to at least one tire on the moving vehicle;

deploying the second member in a direction generally transverse to a direction of travel the moving vehicle such that the second member moves axially away from the first member, thereby positioning the tire puncture strip in front of the at least one tire; and causing the tire puncture strip to engage the at least one tire.

19. The method of claim 18, wherein the deploying step includes forcing a media to the first member, thereby causing the second member to move axially away from the first member.

20. The method of claim 18, further comprising retracting said second member axially towards said first member.

21. The method of claim 18, further comprising permitting movement of the tire puncture strip rearward from a home position at least after the tire puncture strip has engaged the tire.

22. A tire puncture strip, comprising an elongate base having a leading edge and a trailing edge, the leading edge adapted to first engage a tire to be punctured;

a plurality of generally upstanding pointed members disposed about at least a portion of the length of the elongate base; and a plurality of generally upstanding knife edges disposed about at least a portion of the length of the elongate base, wherein the pointed member includes a body portion having one or more channels disposed therein that are adapted to allow for air to pass from an internal portion of the tire to the atmosphere.

23. The tire puncture strip of claim 22, wherein a separate one of the plurality of pointed members is positioned in line with a corresponding separate one of the plurality of knife edges.

24. The tire puncture strip of claim 23, wherein the pointed member is adapted to engage the tire prior to the knife edge engaging the tire.

25. The tire puncture strip of claim 22, wherein the knife edge has an apex, and an angle formed between a leading knife edge portion and the apex is different from an angle formed between a trailing knife edge portion and the apex.

26. The tire puncture strip of claim 22, wherein the pointed member is disposed at an angle relative to a vertical plane perpendicular to the strip.

27. The tire puncture strip of claim 26, wherein the angle is between 0 and 45 degrees.

28. The tire puncture strip of claim 22, wherein the body portion includes one or more surface features that restrict removal of the pointed member from a tire.

29. The tire puncture strip deployment device of claim 22, wherein the pointed member is removable from the strip.

30. The tire puncture strip of claim 28, wherein the pointed member includes a slot and the knife edge includes a corresponding slot, wherein the pointed member engages the knife edge slot such that the knife edge helps support the pointed member.

* * * * *